US011450468B2

(12) United States Patent
Inaba

(10) Patent No.: US 11,450,468 B2
(45) Date of Patent: Sep. 20, 2022

(54) REACTOR

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventor: Kazuhiro Inaba, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 370 days.

(21) Appl. No.: 16/762,668

(22) PCT Filed: Nov. 6, 2018

(86) PCT No.: PCT/JP2018/041173
§ 371 (c)(1),
(2) Date: May 8, 2020

(87) PCT Pub. No.: WO2019/102843
PCT Pub. Date: May 31, 2019

(65) Prior Publication Data

US 2021/0174998 A1 Jun. 10, 2021

(30) Foreign Application Priority Data

Nov. 21, 2017 (JP) ..... JP2017-223948

(51) Int. Cl.
*H01F 17/04* (2006.01)
*H01F 3/14* (2006.01)
*H01F 27/32* (2006.01)

(52) U.S. Cl.
CPC ..... *H01F 17/045* (2013.01); *H01F 3/14* (2013.01); *H01F 27/324* (2013.01); *H01F 2017/048* (2013.01)

(58) Field of Classification Search
CPC ..... H01F 17/045; H01F 3/14; H01F 27/324; H01F 2017/048; H01F 2003/106; H01F 3/10; H01F 27/255; H01F 37/00
See application file for complete search history.

(56) References Cited

U.S. PATENT DOCUMENTS 10,535,460 B2 * 1/2020 Hirabayashi ..... H01F 27/28
10,665,386 B2 * 5/2020 Hirabayashi ..... H01F 27/022
(Continued)

FOREIGN PATENT DOCUMENTS

JP 2011-199238 A 10/2011
JP 2011-253982 A 12/2011
(Continued)

OTHER PUBLICATIONS

Dec. 12, 2018 Search Report issued in International Patent Application No. PCT/JP2018/041173.

*Primary Examiner* — Jared Fureman
*Assistant Examiner* — Michael J Warmflash
(74) *Attorney, Agent, or Firm* — Oliff PLC

(57) ABSTRACT

A reactor including: a coil having a winding portion; a magnetic core that is disposed extending inside and outside the winding portion, and is configured to form a closed magnetic circuit; and a resin mold that includes an inner resin disposed between the winding portion and the magnetic core, and does not cover an outer peripheral face of the winding portion.

6 Claims, 3 Drawing Sheets

(56) References Cited

U.S. PATENT DOCUMENTS

| | | | | |
|---|---|---|---|---|
| 11,282,626 | B2 * | 3/2022 | Kusawake | H01F 27/266 |
| 2012/0154093 | A1 * | 6/2012 | Yoshikawa | H01F 27/022<br>336/180 |
| 2018/0261370 | A1 * | 9/2018 | Hirabayashi | H01F 27/24 |
| 2019/0259532 | A1 | 8/2019 | Hirabayashi et al. | |
| 2020/0395161 | A1 * | 12/2020 | Inaba | H01F 27/24 |

FOREIGN PATENT DOCUMENTS

| | | | |
|---|---|---|---|
| JP | 2014-120743 | A | 6/2014 |
| JP | 2017-135334 | A | 8/2017 |

* cited by examiner

REACTOR

BACKGROUND

The present disclosure relates to a reactor.

This application is based upon and claims the benefit of priority from Japanese Patent Application No. 2017-223948 filed Nov. 21, 2017, the entire content of which is hereby incorporated by reference.

As a reactor for use in an in-vehicle converter or the like, JP 2017-135334A discloses a reactor that includes a coil, a magnetic core, and a resin molded portion. The coil includes a pair of winding portions. The magnetic core includes multiple inner core pieces that are disposed inside the winding portions, and two outer core pieces that are disposed outside the winding portions, and these core pieces are combined into a ring shape. The resin molded portion covers outer peripheral faces of the magnetic core, and exposes the coil and does not cover it.

SUMMARY

A reactor according to the present disclosure includes: a coil having a winding portion; a magnetic core that is disposed extending inside and outside the winding portion, and is configured to form a closed magnetic circuit; and a resin mold that includes an inner resin disposed between the winding portion and the magnetic core, and does not cover an outer peripheral face of the winding portion, wherein the magnetic core includes an inner core piece that has a predetermined magnetic path sectional area and is disposed inside the winding portion, and an outer core piece that has a small area portion having a connecting face that is connected to an end face of the inner core piece and has a smaller area than the end face, and a large area portion having a magnetic path sectional area that is larger than the area of the end face of the inner core piece, the large area portion being exposed from the winding portion, a relative permeability of the outer core piece is higher than a relative permeability of the inner core piece, and the resin mold has a thick portion that covers a connection location between the end face of the inner core piece and the connecting face of the small area portion, the thick portion being thicker than a portion of the mold that covers an outer peripheral face of the inner core piece.

DETAILED DESCRIPTION OF EMBODIMENTS

Figure 1:
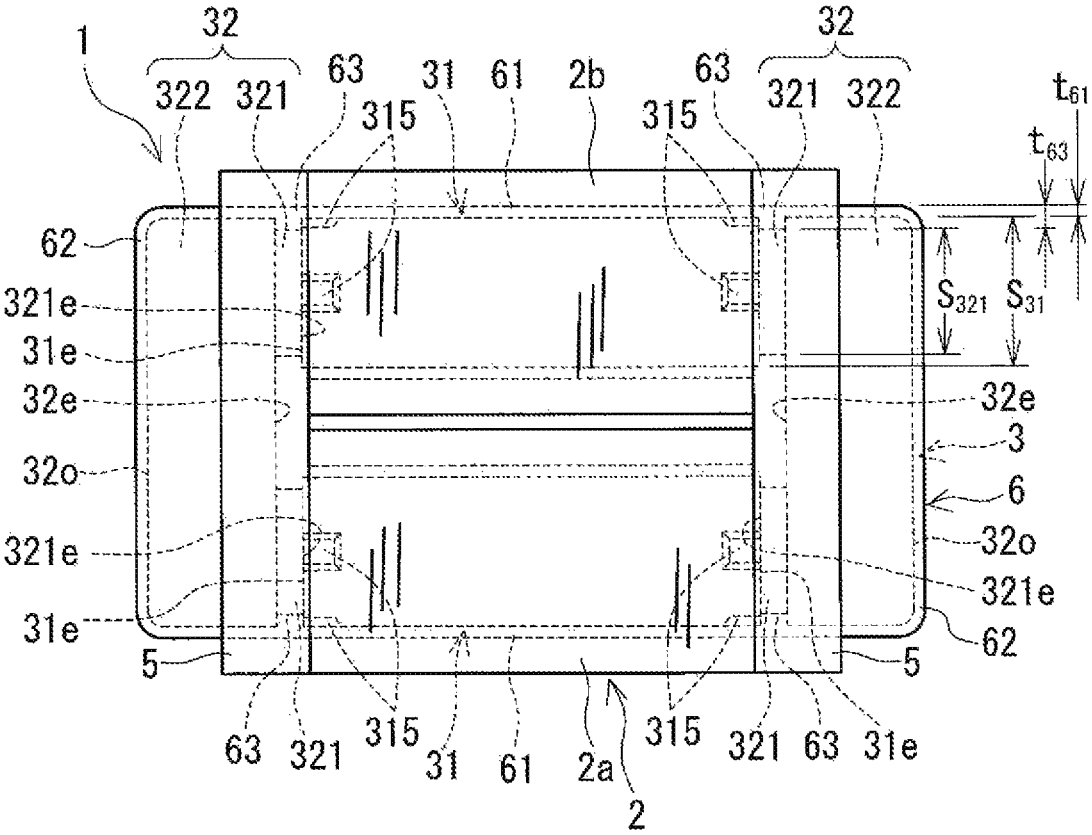
FIG. 1 is a schematic plan view of a reactor according to a first embodiment.

There has been desire for a reactor that has excellent strength and enables a resin molded portion to be formed easily.

In the case where the magnetic core that includes inner core pieces and outer core pieces is held in an integrated state by the resin molded portion as described in JP 2017-135334A, there is particularly desire for an increase in the connection strength between the inner core pieces and the outer core pieces, and excellent strength as an integrated body in the magnetic core. For example, the connection strength increases if the overall thickness of the resin molded portion is increased, but this invites an increase in the size of the reactor.

Also, the outer core piece described in JP 2017-135334A is a columnar body in which the inner end face for connection to the end faces of the inner core pieces is a uniform flat surface, and the lower face of the outer core piece protrudes downward beyond the lower faces of the inner core pieces. However, because the outer core piece includes this protruding portion, it is difficult to form the resin molded portion that covers the outer peripheral faces of the magnetic core while exposing the coil. This is because flow-state resin, which is the raw material for forming the resin molded portion (hereinafter, also called the mold raw material), cannot easily be introduced into the tube-shaped gap between the winding portion and the inner core pieces (hereinafter, also called the tubular gap).

Specifically, when the inner core piece is combined with the outer core piece that has a protruding portion, the outer core piece is disposed so as to block at least a portion of openings formed by the inner peripheral edge of the winding portion and the peripheral edge of the end face of the inner core piece. If the opening is blocked by the outer core piece, the area of the opening for introduction of the mold raw material into the tubular gap decreases, and the mold raw material cannot easily be introduced into the tubular gap. Particularly in the case where the tubular gap is reduced in size in order to obtain a smaller reactor, it is even more difficult to fill the gap with the mold raw material. Accordingly, there is desire for a configuration that makes it easier to fill the tubular gap with the mold raw material even if the tubular gap has been made smaller.

In view of this, one object of the present disclosure is to provide a reactor that has excellent strength and enables the resin molded portion to be formed easily.

A reactor according to the present disclosure has excellent strength and enables the resin molded portion to be formed easily.

DESCRIPTION OF EMBODIMENTS OF THE DISCLOSURE

First, embodiments of the present disclosure will be listed and described.

(1) A reactor according to an embodiment of the present disclosure includes:

a coil having a winding portion;

a magnetic core that is disposed extending inside and outside the winding portion, and is configured to form a closed magnetic circuit; and a resin molded portion that includes an inner resin portion disposed between the winding portion and the magnetic core, and does not cover an outer peripheral face of the winding portion, wherein the magnetic core includes an inner core piece that has a predetermined magnetic path sectional area and is disposed inside the winding portion, and an outer core piece that has a small area portion having a connecting face that is connected to an end face of the inner core piece and has a smaller area than the end face, and a large area portion having a magnetic path sectional area that is larger than the area of the end face of the inner core piece, the large area portion being exposed from the winding portion, a relative permeability of the outer core piece is higher than a relative permeability of the inner core piece, and the resin molded portion has a thick portion that covers a connection location between the end face of the inner core piece and the connecting face of the small area portion, the thick portion being thicker than a portion of the resin molded portion that covers an outer peripheral face of the inner core piece.

The above-described reactor includes the resin molded portion that covers at least one portion of the inner core piece in a state of exposing the winding portion. For this reason, the insulation performance between the winding portion and the inner core piece can be improved by the inner resin portion, and in the case where the reactor is cooled by a cooling medium such as a liquid coolant, the winding portion can be brought into direct contact with the cooling medium, thus achieving excellent heat dissipation performance. The outer core piece provided in the reactor includes the large area portion that has a larger magnetic path sectional area than the inner core piece. For this reason, compared to the case where the entirety of the outer core piece has the same magnetic path sectional area as the small area portion, heat is more easily dissipated from the large area portion, and the large area portion more easily comes into contact with the aforementioned cooling medium. Accordingly, the above-described reactor has even more excellent heat dissipation performance. If the surface area is higher due to the provision of the large area portion, the heat dissipation performance of the reactor is even more excellent.

In particular, in the above-described reactor, the resin molded portion includes the thick portion at a position covering the connection location between the inner core piece and the outer core piece. The thick portion is not likely to crack due to being thicker than the portion of the resin molded portion that covers the inner core piece (mainly the inner resin portion), and contributes to an improvement in the connection strength between the inner core piece and the outer core piece. Accordingly, in the above-described reactor, it is possible to improve the integrated body strength of the magnetic core that is held in an integrated state by the resin molded portion, and the strength is excellent. If the thick portion is shaped as a ring and is continuous in the peripheral direction of the small area portion, the strength is even more excellent. Also, in the above-described reactor, the thick portion is provided at a predetermined location, thus achieving a smaller size than in the case where the thickness of the entirety of the resin molded portion is increased, while also achieving superior strength.

Furthermore, in the above-described reactor, the outer core piece includes the large area portion, and also includes the small area portion in the vicinity of the opening of the tubular gap between the winding portion and the inner core piece. Accordingly, the mold raw material is easily introduced into the tubular gap through the region including the opening. The small area portion has a step portion that is not flush with an outer peripheral face of the inner core piece, in a outer peripheral face. For this reason, when the reactor is viewed in the axial direction of the winding portion, the gap between an inner peripheral edge of the winding portion and a peripheral edge of the step portion in the small area portion is larger than the tubular gap between the inner peripheral faces of the winding portion and the outer peripheral faces of the inner core piece. This space around the small area portion can be used as an introduction space for introduction of the mold raw material into the tubular gap. If all of the outer peripheral faces of the small area portion are not flush with the outer peripheral faces of the inner core piece, it is possible to form the introduction space so as to extend entirety around the small area portion, and the mold raw material can be introduced more easily. Even if the tubular gap is set smaller for example, the introduction space can be formed in the vicinity of the opening, and therefore the mold raw material can be introduced easily. Accordingly, with the above-described reactor, the tubular gap between the winding portion and the inner core piece is easily filled with the mold raw material, and the resin molded portion can be formed easily.

Moreover, in the above-described reactor, the relative permeability of the outer core piece is higher than the relative permeability of the inner core piece. For this reason, even if the connecting face of the small area portion that forms the connection between the outer core piece and the inner core piece is smaller than the end face of the inner core piece, it is possible to reduce flux leakage between the core pieces. Accordingly, with the above-described reactor, it is possible to reduce an increase in loss attributed to flux leakage, and a low-loss reactor can be obtained.

(2) In an example of the above-described reactor, the inner core piece is constituted by a compact made of a composite material that contains a magnetic powder and a resin, and the area of the connecting face is greater than or equal to a value obtained by multiplying the area of the end face of the inner core piece by a filling rate of the magnetic powder.

The relative permeability of the composite material compact changes according to the filling rate of the magnetic powder. Accordingly, the product value in the above aspect can be said to be the effective magnetic path area of the inner core piece. The area of the connecting face of the outer core piece is greater than or equal to the effective magnetic path area of the inner core piece. Accordingly, although the connecting face of the outer core piece is smaller than the end face of the inner core piece in the above aspect, it is possible to more reliably reduce flux leakage between the inner core piece and the outer core piece. In particular, if the filling rate of the magnetic powder is low, and the relative permeability of the inner core piece is reduced to a certain extent (see section (4) below), it is possible to obtain a magnetic core that has no magnetic gap. The gapless-structure magnetic core has substantially no flux leakage that is attributed to a magnetic gap, thus making it possible to reduce the size of the tubular gap. In this case, it is possible to further reduce loss caused by flux leakage attributed to a magnetic gap, and a smaller size can be achieved due to the small tubular gap. Even if the tubular gap is small, the mold raw material can be easily introduced into the tubular gap due to the formation of the introduction space as described above, and the resin molded portion can be formed easily.

(3) In an example of the above-described reactor, the inner core piece includes an introduction groove that is open at an outer peripheral face and the end face of the inner core piece.

The introduction groove in the above aspect is formed in a region of the end face of the inner core piece that forms the above-described step portion with the small area portion, thus forming a space that is in communication with both the above-described introduction space and the tubular gap. If the all of the outer peripheral faces of the small area portion are not flush with the outer peripheral faces of the inner core piece, a space that is in communication with both the above-described introduction space and the tubular gap is formed by the introduction groove being formed in any region of the end face of the inner core piece. In the above aspect including this introduction groove, the mold raw material can more easily be introduced from the introduction space to the tubular gap via the introduction groove, and the resin molded portion can be formed more easily. Also, the thickness of the portion of the resin molded portion that covers the introduction groove of the inner core piece is greater than the thickness of the portion that covers the region other than the region of the inner core piece where the introduction groove is formed, and furthermore this portion of the resin molded portion is continuous with the thick portion. Accordingly, in the above aspect, the resin molded portion includes more locally thick portions in the vicinity of the connections between the inner core piece and the outer core piece, and the connection strength between the core pieces is further improved, thus achieving even more excellent strength. If the inner core piece is a composite material compact, even in the case of having uneven portions due to the provision of the introduction groove, the inner core piece can be molded easily and precisely, and the inner core piece has excellent manufacturability as well.

(4) In an example of the above-described reactor, a relative permeability of the inner core piece is in a range of 5 to 50 inclusive, and a relative permeability of the outer core piece is a factor of 2 times or more the relative permeability of the inner core piece.

In the above aspect, the relative permeability of the outer core piece is higher than the relative permeability of the inner core piece. For this reason, it is possible to more reliably reduce flux leakage between the core pieces. Due to this difference, flux leakage can be substantially eliminated. Also, in the above aspect, the relative permeability of the inner core piece is low. This therefore makes it possible to obtain a gapless-structure magnetic core. Accordingly, with the above aspect, it is possible to further reduce loss attributed to flux leakage as described in section (2) above and to achieve a further size reduction, while also enabling the resin molded portion to be formed easily.

(5) In an example of the reactor according to (4), the relative permeability of the outer core piece is in a range of 50 to 500 inclusive.

In the above aspect, the relative permeability of the outer core piece satisfies not only section (4) above but also the specific range described above. For this reason, it is possible to easily increase the difference between the relative permeability of the outer core piece and the relative permeability of the inner core piece. If the difference is large (e.g., greater than or equal to 100), it is also possible to reduce flux leakage between the core pieces even if the size of the small area portion is set smaller. If the small area portion is made smaller, the introduction space can be made larger, thus making it even easier for the mold raw material to be introduced into the tubular gap, and making it even easier to form the resin molded portion.

(6) In an example of the above-described reactor, the small area portion is exposed from the winding portion.

In the above aspect, loss such as copper loss attributed to flux leakage is more easily reduced than in the case where at least a portion of the small area portion is disposed inside the winding portion.

DETAILS OF EMBODIMENTS OF THE DISCLOSURE

Hereinafter, embodiments of the present disclosure will be described in detail with reference to the drawings. In the drawings, like reference numerals denote objects having like names.

First Embodiment

Figure 2A:
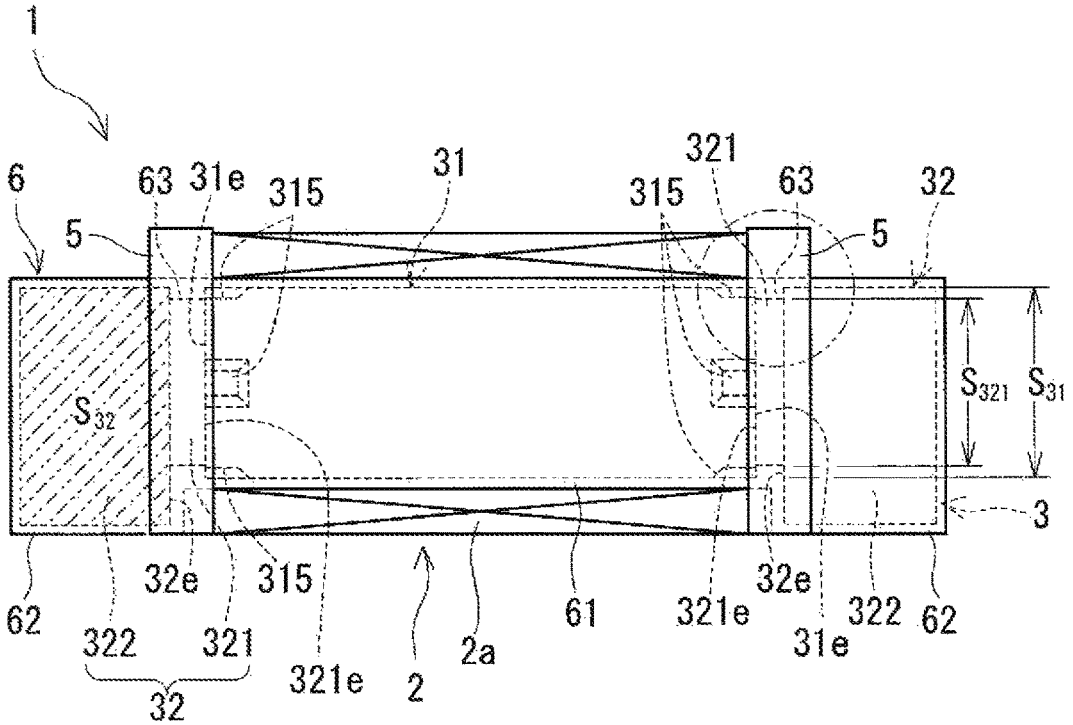
FIG. 2A is a schematic side view of the reactor according to the first embodiment.
Figure 2B:
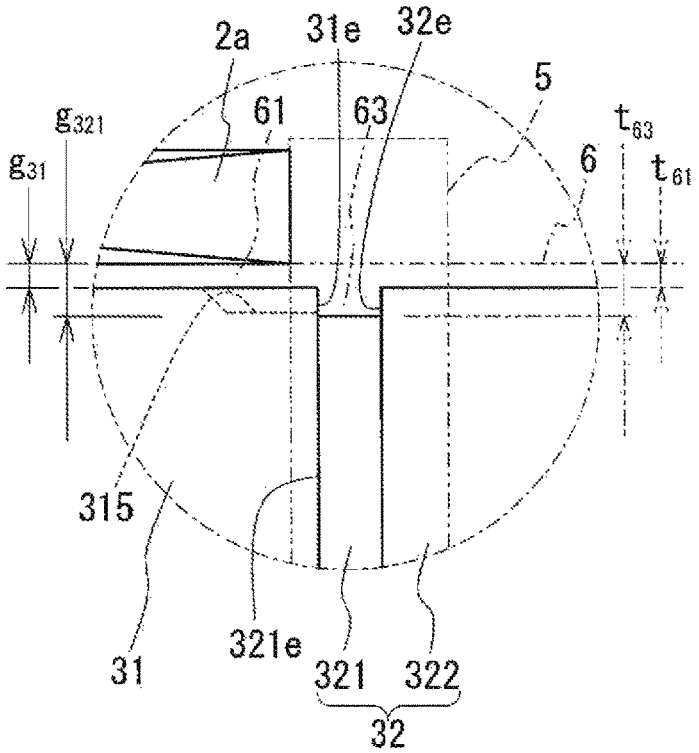
FIG. 2B is an enlarged schematic side view of a portion of the reactor in FIG. 2A.
Figure 3:
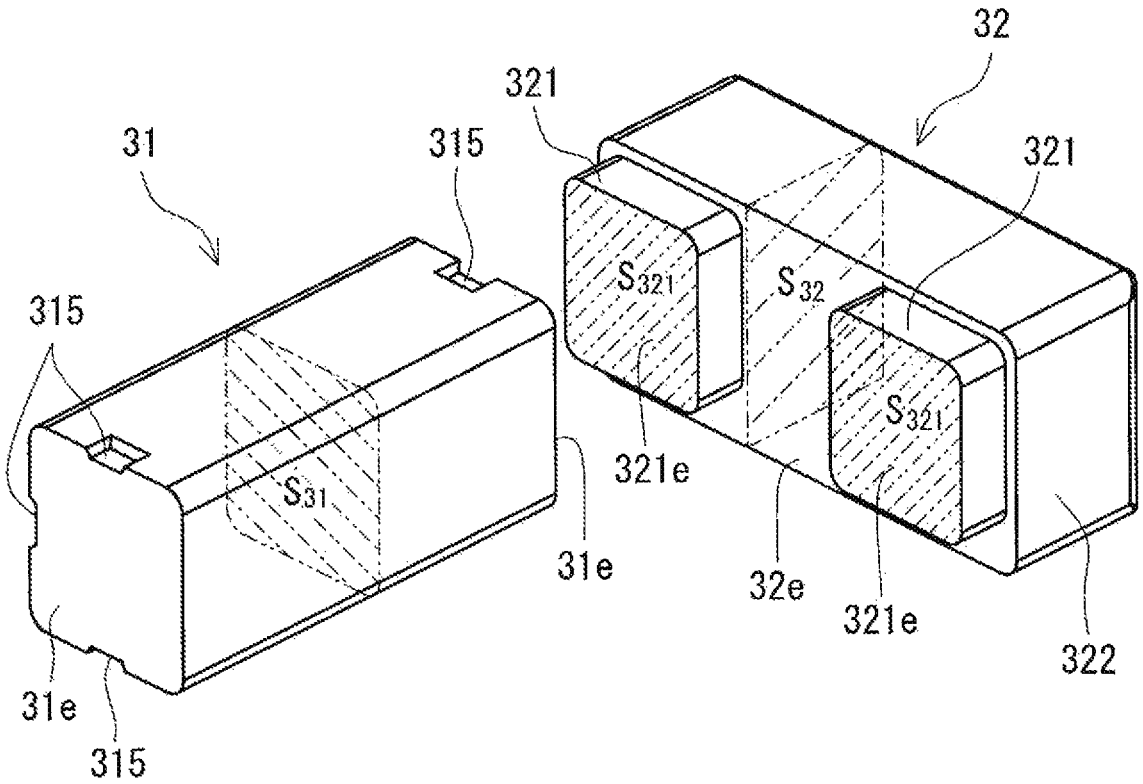
FIG. 3 is a schematic perspective view of an inner core piece and an outer core piece provided in the reactor according to the first embodiment.

The following describes a reactor 1 according to a first embodiment with reference to FIGS. 1 to 3.

In the following description, the installation side of the reactor 1 that comes into contact with the installation target is called the lower side, and the side opposite thereto is called the upper side. FIG. 2A illustrates the case where the lower side of the paper surface is the installation side of the reactor 1. FIG. 2A shows a vertical cross-section in which the winding portion 2*a* has been cut at a plant parallel to the axial direction thereof, and shows a state in which an inner resin portion 61 is exposed. Also, FIG. 2B shows an enlargement of the portion in the circular dash-dotted line in FIG. 2A. FIG. 2B shows an enlargement of a region including the connection location between one inner core piece 31 and one outer core piece 32, and in this figure, the resin molded portion 6 (resin mold) and an intermediate member 5 are shown virtually with use of dashed double-dotted lines.

1. Overview

As shown in FIG. 1, the reactor 1 of the first embodiment includes a coil 2, a magnetic core 3 that forms a closed magnetic circuit, and a resin molded portion 6. In this example, the coil 2 includes a pair of winding portions 2*a* and 2*b*. The winding portions 2*a* and 2*b* are disposed laterally adjacent to each other with parallel axes. The magnetic core 3 includes a two inner core pieces 31 that are disposed in the winding portions 2*a* and 2*b*, and two outer core pieces 32 that include portions (large area portions 322) that are exposed from the winding portions 2*a* and 2*b*. The resin molded portion 6 includes two inner resin portions 61 (inner resins) that are respectively arranged between the winding portions 2*a* and 2*b* and the magnetic core 3 (here, the two inner core pieces 31). The resin molded portion 6 exposes the outer peripheral faces of the winding portions 2*a* and 2*b* and does not cover them. The magnetic core 3, which extends inside and outside the winding portions 2*a* and 2*b*, is assembled into a ring shape by disposing the two outer core pieces 32 so as to sandwich the two inner core pieces 31 that are laterally adjacent and extend along the winding portions 2*a* and 2*b*. This type of reactor 1 is typically used in a state of being attached to an installation target such as a converter case (not shown).

In particular, in the reactor 1 of the first embodiment, the outer core piece 32 includes relatively small portions (small area portions 321) as portions for connection with the inner core pieces 31. The resin molded portion 6 includes thick portions 63 that surround the connection locations between the inner core pieces 31 and the locally-small small area portions 321. Due to the small area portions 321 of the outer core piece 32 being locally small, before the resin molded portion 6 is formed, a space (an introduction space $g_{321}$) that is larger than a tubular gap $g_{31}$ between the winding portion 2*a* (or 2*b*) and the inner core piece 31 is formed around each of the small area portions 321 at the connections with the two core pieces 31 and 32 as shown by the enlargement in FIG. 2B. Furthermore, the relative permeability of the outer core piece 32 is higher than the relative permeability of the inner core piece 31. According to this reactor 1, the mold raw material can be easily introduced into the tubular gap $g_{31}$ through the introduction space $g_{321}$, and the resin molded portion 6 can be formed easily. Also, in this reactor 1, the connection strength between the core pieces 31 and 32 is excellent due to the thick portions 63. Furthermore, this reactor 1 can reduce flux leakage between the core pieces 31 and 32.

Hereinafter, the constituent elements will each be described in detail.

2. Coil

The coil 2 in this example includes the tube-shaped winding portions 2*a* and 2*b*, which are formed by winding a winding wire into a spiral shape. The following are aspects of the coil 2 that includes the pair of laterally adjacent winding portions 2*a* and 2*b*.

(α) The coil 2 includes the winding portions 2*a* and 2*b* that are formed by a single continuous winding wire, and a coupling portion that is constituted by a portion of the winding wire that spans the winding portions 2*a* and 2*b*, and that couples the winding portions 2*a* and 2*b*.

(β) The coil 2 includes the winding portions 2*a* and 2*b* that are formed by two independent winding wires, and a joining portion that is obtained by performing welding, pressure bonding, or the like on the end portions on one side of the winding wires that have been drawn out from the winding portions 2*a* and 2*b*.

In both of the above aspects, the end portions (other end portions in aspect β) of the winding wires drawn out from the winding portions 2*a* and 2*b* are used as connections for connection to an external apparatus such as a power supply.

One example of the winding wire is a coated wire that includes a conductor wire made of copper or the like, and an insulating coating that is made of a polyamide imide resin or the like and surrounds the conductor wire. The winding portions 2*a* and 2*b* in this example are each a quadrangular tube-shaped edgewise coil in which the winding wire, which is constituted by a coated rectangular wire, is wound edgewise. The winding portions 2*a* and 2*b* in this example have the same specifications in terms of shape, winding direction, and number of turns, for example. The shape, size, and the like of the winding wires and the winding portions 2*a* and 2*b* can be selected as desired. For example, the winding wires may be coated round wires, and the winding portions 2*a* and 2*b* may be shaped as a tube that does not have corner portions, such as a circular tube, an elliptical tube, or a racetrack shape. Also, the winding portions 2*a* and 2*b* may have different specifications from each other.

In the reactor 1 of the first embodiment, the outer peripheral faces of the winding portions 2*a* and 2*b* are completely exposed and not covered by the resin molded portion 6. On the other hand, the inner resin portions 61, which are part of the resin molded portion 6, are disposed inside the winding portions 2*a* and 2*b*, and the inner peripheral faces of the winding portions 2*a* and 2*b* are covered by the resin molded portion 6.

3. Magnetic Core 3.1 Overview

The outer peripheral faces of the magnetic core 3 in this example are covered by the resin molded portion 6 in the state where the two inner core pieces 31 and the two outer core pieces 32 described above have been combined to form a ring shape. The magnetic core 3 is held in the integrated state by the resin molded portion 6. The magnetic core 3 in this example has a gapless structure in which substantially no magnetic gap exists between the core pieces.

In the reactor 1 of the first embodiment, the magnetic path sectional area of the outer core piece 32 is different in portions rather than being uniform over the entire length. Specifically, the outer core piece 32 includes small area portions 321 and a large area portion 322. As shown in FIG. 3, the small area portions 321 each include a connecting face 321*e* for connection with an end face 31*e* of one inner core piece 31. An area $S_{321}$ (here, also corresponds to a magnetic path sectional area) of the connecting face 321*e* is smaller than an area $S_{31}$ (here, also corresponds to a magnetic path sectional area) of the end face 31*e* of the inner core piece 31 (see FIGS. 1 and 2A as well). The large area portion 322 has a larger magnetic path sectional area $S_{32}$ than the area $S_{31}$ of the end face 31*e* of the inner core piece 31. The outer core piece 32 has a step-like shape in which the portions 321 and 322 are integrated with each other. In this example, the small area portions 321 are disposed so as to be coaxial with the inner core pieces 31, and the large area portion 322 connects the two small area portions 321 that are laterally adjacent to each other, without being connected to the inner core pieces 31 (FIG. 1)

In the state where the coil 2 and the magnetic core 3 have been combined, the two inner core pieces 31 are disposed inside the winding portions 2*a* and 2*b*, and the large area portions 322 of the two outer core pieces 32 are exposed from the winding portions 2*a* and 2*b*. In this example, the small area portions 321 of the outer core pieces 32 are exposed from the winding portions 2*a* and 2*b*, and are disposed in a state of protruding from the end faces of the winding portions 2*a* and 2*b* (FIG. 2A). In this assembled state, as shown in FIG. 2B, grooves are formed by the end faces 31*e* of the inner core pieces 31, the outer peripheral faces of the small area portions 321, and the inward end faces 32*e* of the large area portions 322. In this example, the ring-shaped grooves are continuous along the outer periphery of the small area portions 321. These ring-shaped grooves are portions forming the thick portions 63 of the resin molded portion 6.

Hereinafter, the inner core piece 31 and the outer core piece 32 will be described in this order.

3.2 Inner Core Piece

In this example, the portion of the magnetic core 3 that is disposed inside the winding portion 2*a* and the portion of the magnetic core 3 that is disposed inside the winding portion 2*b* are both mainly constituted by one columnar inner core piece 31 (FIG. 1). One end face 31*e* of one of the inner core pieces 31 is joined to the connecting face 321*e* of one of the outer core pieces 32, and the other end face 31*e* is joined to the connecting face 321*e* of the other outer core piece 32 (FIG. 2A). Note that in this example, later-described intermediate members 5 are disposed at the joints between the core pieces 31 and 32.

The two inner core pieces 31 in this example have the same shape and the same size. Each of the inner core pieces 31 has a cuboid shape as shown in FIG. 3. The shape of the inner core piece 31 can be changed as desired. For example, the inner core piece 31 may be shaped as a circular column, or a polygonal column such as a hexagonal column. In the case of being shaped as a polygonal column, the corner portions of the inner core piece 31 may be subjected to C chamfering or R chamfering as shown in FIG. 3, for example. Rounding the corner portions not only suppresses chipping and achieves excellent strength, but also makes it possible to reduce the weight and increase the area of contact with the inner resin portion 61.

The inner core piece 31 in this example has a predetermined magnetic path sectional area $S_{31}$ over the entire length thereof, with the exception of a formation region for an introduction groove 315 (described in detail later). For this reason, the magnetic core 3 can sufficiently ensure the portions having the magnetic path sectional area $S_{31}$, and also have a predetermined magnetic characteristic. In FIG. 3, the magnetic path sectional area $S_{31}$ of the inner core piece 31, the area $S_{321}$ of the small area portions 321 of the outer core piece 32, and the magnetic path sectional area $S_{32}$ of the large area portion 322 are shown virtually.

3.3 Outer Core Piece

In this example, the portion of the magnetic core 3 that is disposed outside the winding portion 2*a* and the portion of the magnetic core 3 that is disposed outside the winding portion 2*b* are both mainly constituted by one columnar outer core piece 32 (FIG. 1).

The two outer core pieces 32 in this example have the same shape and the same size. As shown in FIG. 3, the outer core piece 32 is shaped as a relatively large cuboid body with two relatively smaller and thin cuboid bodies disposed side-by-side on one face, and is U-shaped in a plan view (FIG. 1). Specifically, each outer core piece 32 includes the large area portion 322 that is shaped as a cuboid body, and the two small area portions 321 that are shaped as cuboid bodies (plates). The two small area portions 321 protrude toward the winding portions 2*b*, from a flat inward end face 32*e* of the large area portion 322 that faces the end faces of the winding portions 2*b*. The small area portions 321 of each outer core piece 32 are provided in correspondence with the locations on the inward end face 32*e* for connection to the end faces 31*e* of the two inner core pieces 31 that are disposed side-by-side along the winding portions 2*a* and 2*b*.

Each of the small area portions 321 in this example is a column-shaped body that has a uniform magnetic path sectional area $S_{321}$ over the entire length thereof, including the connecting face 321*e* for connection to the end face 31*e* of one inner core piece 31. The area $S_{321}$ of the connecting face 321*e* is smaller than the area $S_{31}$ of the end face 31*e* of the inner core piece 31 ($S_321<S_{31}$). Due to having the different area $S_{321}$ and $S_{31}$, the outlines of these two faces are different as well. A space (introduction space $g_{321}$) formed by the step portion formed by this size different is used as a guide portion for guiding the mold raw material to the tubular gaps $g_{31}$ between the winding portions 2*a* and 2*b* and the two inner core pieces 31 when forming the resin molded portion 6. The introduction spaces $g_{321}$ are also used as portions for forming the thick portions 63 (FIG. 2B).

By adjusting the size of the above-described step portions, it is possible to adjust the size of the thick portions 63 and the ease of introduction of the mold raw material into the tubular gaps $g_{31}$. For example, the larger the step height of the step portion is, or the wider the step portion is, the larger the introduction space $g_{321}$ can be formed, thus making it possible to improve the ease of introduction and make the thick portion 63 thicker or wider. Also, formation length of the step portion and the peripheral length of the introduction space $g_{321}$ and the thick portion 63 change depending on the outer shape of the small area portion 321, the location where the small area portion 321 is formed on the inward end face 32*e* of the large area portion 322, and the like. For example, if the formation location of the small area portion 321 is adjusted such that one or more of the outer peripheral faces of the small area portion 321 is flush with an outer peripheral face of the inner core piece 31, the step can be provided at only one or more of the outer peripheral faces of the small area portion 321. If the small area portions 321 and the inner core pieces 31 have similar shapes and are aligned coaxially as in this example, the step is provided along the entire periphery of the small area portion 321. As a result, the introduction space $g_{321}$ has a uniform thickness, and the thick portion 63 is ring-shaped. If the thick portion 63 is shaped as a thicker and wider ring, the connection strength between the core pieces 31 and 32 can increase further, and thus is preferable. Note that the step height is considered to be the size in the direction orthogonal to the axial direction of the winding portions 2*a* and 2*b*. The width of the step portion is considered to be the size along the axial direction of the winding portions 2*a* and 2*b*. Here, the width corresponds to the protruding height of the small area portion 321 from the inward end face 32*e* of the large area portion 322.

The smaller the magnetic path sectional area $S_{321}$ of the small area portion 321 is, the larger the step height of the step portion can be. Also, the larger the protruding height of the small area portion 321 is, the wider the step portion can be. However, if the magnetic path sectional area $S_{321}$ is too small, or the protruding height is too large, the proportion of the portion having the magnetic path sectional area $S_{321}$ lower than the magnetic path sectional area $S_{31}$ in the magnetic core 3 increases, thus making it likely for magnetic saturation to occur, and making it possible for flux leakage from the small area portion 321 to increase. In consideration of the ease of introduction, connection strength, magnetic characteristics such as magnetic saturation and flux leakage, and the like, the magnetic path sectional area $S_{321}$ of the small area portion 321 is in the range of greater than or equal to 60% to less than 100% of the magnetic path sectional area $S_{31}$ of the inner core piece 31, or further in the range of 65% to 98% inclusive or 70% to 95% inclusive, for example. Also, the step height is in the range of 0.1 mm to 2 mm inclusive, or further 0.5 mm to 1.5 mm or 1.2 mm inclusive, for example. Also, the width (protruding height) of the step portion is in the range of 1% to 35% inclusive of the length of the winding portions 2*a* and 2*b*, or further in the range of 5% to 20% or 15% inclusive, for example.

The two small area portions 321 in this example are exposed from the winding portions 2*a* and 2*b* in the state where the coil 2 and the magnetic core 3 have been combined. In other words, the outer core pieces 32 in this example are completely exposed from the winding portions 2*a* and 2*b*. Note that by adjusting the length of the inner core pieces 31 and the length of the small area portions 321, it is possible for the two small area portions 321 to at least partially be disposed inside the winding portions 2*a* and 2*b*.

Although the small area portion 321 in this example has a cuboid shape, the shape can be changed as desired. For example, the small area portion 321 may be shaped as a circular column, or a polygonal column such as a hexagonal column. If the small area portion 321 has a uniform area $S_{321}$ over the entire length thereof, and has the connecting face 321*e* that has a shape similar to that of the end face 31*e* of the inner core piece 31 as in this example, it is possible to form the ring-shaped introduction space $g_{321}$ as described above, and thus is preferable.

The large area portion 322 is a column-shaped body that has the magnetic path sectional area $S_{32}$ that is larger than the magnetic path sectional area $S_{31}$ of the inner core piece 31 ($S_{31}<S_{32}$). In other words, the magnetic core 3 satisfies the relationship $S_{321}<S_{31}<S_{32}$ in terms of area. Note that if the outer core piece 32 has the small area portions 321 and the large area portion 322, it can include the portion that has the magnetic path sectional area $S_{31}$.

3.4 Assembled State

When the end faces 31*e* of the inner core pieces 31 are connected to the connecting faces 321*e* of the small area portions 321 of the outer core pieces 32 to assemble the magnetic core 3, and the magnetic core 3 is viewed in the axial direction of the winding portions 2*a* and 2*b* from the outward end face 32*o* (FIG. 1) of one of the outer core pieces 32 (i.e., viewed from the front), the end faces 31*e* of the two inner core pieces 31 are both overlapped by the outer core piece 32 and not visible. This is because in the outer core piece 32 in this example, the area of the inward end face 32*e* is greater than the total area of the end faces 31*e* of the inner core pieces 31 ($2\times S_{31}$), and the outer peripheral faces (upper and lower faces in FIG. 1) of the outer core piece 32 are flush with the outer peripheral faces of the two inner core pieces 31.

Note that the introduction space $g_{321}$ that is larger than the tubular gap $g_{31}$ can be formed around each of the small area portions 321 of the outer core piece 32 before the resin molded portion 6 is formed. In this example, the two small area portions 321 are exposed from the winding portions 2*a* and 2*b*, and therefore the introduction spaces $g_{321}$ can be formed between the end faces of the winding portions 2*a* and 2*b* and the inward end face 32*e* of the large area portion 322 of the outer core piece 32 (FIG. 2B). Accordingly, when the mold raw material is supplied from the outward end face 32*o* side (FIG. 1) of the outer core piece 32, the mold raw material can flow over the outer peripheral face of the large area portion 322 and be introduced into the introduction space $g_{321}$. The mold raw material can then be introduced into the tubular gap $g_{31}$ via the introduction space $g_{321}$. In this example, the mold raw material can be introduced into the tubular gap $g_{31}$ around the entirety of each of the small area portions 321. Note that in the case where the outer core piece 32 is formed such that all of the outer peripheral faces of the small area portions 321 are not flush with the outer peripheral faces of the inner core piece 31, and one or more of the outer peripheral faces of the small area portions 321 are flush with one or more of the outer peripheral faces of the large area portion 322 of the upper surface of the large area portion 322 is set lower in FIG. 2B), then the mold raw material can more easily flow from the outer core piece 32 into the introduction space $g_{312}$.

Due to the outer core piece 32 including the small area portions 321, the introduction groove 315 can be provided in the inner core pieces 31. The introduction groove 315 is an opening in an outer peripheral face of the end face 31*e* of the inner core piece 31 and the region that forms the step portion with the small area portion 321, and the introduction groove 315 forms a space that is in communication with both the introduction space $g_{321}$ and the tubular gap $g_{31}$. For this reason, when forming the resin molded portion 6 that covers the magnetic core 3 while also exposing the coil 2, if the mold raw material is supplied from the outer core piece 32 side toward the coil 2, the mold raw material can easily be introduced into the introduction space $g_{321}$ to the tubular gap $g_{31}$ via the introduction groove 315 (see FIG. 2B as well). Furthermore, the portion of the resin molded portion 6 that covers the introduction groove 315 is thicker than a thickness $t_{61}$ of the region that covers the region of the inner core piece 31 other than the region where the introduction groove 315 is formed, and furthermore is continuous with the thick portion 63. Accordingly, the resin molded portion 6 includes more locally thick portions in the vicinity of the connections between the core pieces 31 and 32, and the connection strength between the core pieces 31 and 32 is further improved.

The shape (opening shape, cross-sectional shape, and the like), the size (depth, opening width, length (size along the axial direction of the inner core piece 31), and the like), the number of, the formation location, and the like of the introduction groove 315 can be selected as desired. The larger the introduction groove 315 is, or the more there are, the higher the ease of introduction of the mold raw material is and the higher the connection strength is. However, if the introduction groove 315 is too large, or there are too many, the percentage of the portion having the magnetic path sectional area $S_{31}$ decreases, magnetic saturation can occur more easily, and flux leakage from the introduction groove 315 and the vicinity thereof can increase. In consideration of the ease of introduction, the connection strength, magnetic characteristics such as magnetic saturation and flux leakage, and the like, the size of the introduction groove 315 is adjusted such that the magnetic path sectional area of the introduction groove 315 formation region in the inner core piece 31 is in the range of $S_{321}$ to $S_{31}$ inclusive, for example. The length of the introduction groove 315 is set to a length less than or equal to 5 turns of the coil 2, or further less than or equal to 2 turns, for example. If all of the outer peripheral faces of the small area portion 321 are not flush with the outer peripheral faces of the inner core piece 31 as in this example, the introduction groove 315 can be formed at position on the end face 31*e* of the inner core piece 31, and there is a high degree of freedom in selecting the formation position.

It is preferable that the opening of the introduction groove 315 is provided in a region of an outer peripheral face of the inner core piece 31 that is at a distance from the region where the adjacent inner core pieces 31 face each other (hereinafter, called the inward region). Magnetic flux passes more easily through the inward region than the region on the distant sides of the adjacent inner core pieces 31. The above configuration is preferable because providing the introduction groove 315 in the inward region can invite an increase in flux leakage from the introduction groove 315 region.

In this example, each end portion of each inner core piece 31 is provided with the introduction groove 315 in three faces (in FIG. 2A, the upper and lower faces and the face on the front side with respect to the paper surface) other than the face that corresponds to the above-described inward region (in FIG. 1, the face that opposes the adjacent inner core piece, and in FIG. 3, the face on the front side with respect to the paper surface). In other words, each inner core piece 31 includes a total of six introduction grooves 315 for the two end portions. In the example illustrated here, the introduction grooves 315 each have the same shape and same size, have rectangular openings, and include a groove bottom face that is substantially parallel with the outer peripheral face of the inner core piece 31, and an inclined face that intersects the groove bottom face and extends from the groove bottom face to the outer peripheral face. The inclined face is inclined such that the groove depth decreases as it extends away from the end face 31*e*. For this reason, the inclined face contributes to facilitating the flow of the mold raw material from the introduction groove 315 toward the tubular gap $g_{31}$.

The two outer core pieces 32 in this example have the same shape and the same size. The two outer core pieces 32 can therefore be manufactured using the same mold. It is also easy to make condition adjustments and the like when forming the resin molded portion 6. In view of these points, the above configuration is excellent in terms of manufacturability. Also, it is possible to change the shape or size of the small area portions 321 between the outer core pieces 32, or change the shape or size of each of the two small area portions 321 of one outer core piece 32. For example, an aspect is possible in which only one of the outer core pieces 32 has the two small area portions 321, and the other outer core piece 32 is not provided with the small area portions 321.

3.5 Characteristics

The relative permeability of the outer core piece 32 is higher than the relative permeability of the inner core piece 31. For this reason, even if the area $S_{321}$ of the small area portion 321 of the outer core piece 32 for connection to the inner core piece 31 is smaller than the magnetic path sectional area $S_{31}$ of the inner core piece 31, it is possible to reduce flux leakage between the core pieces 31 and 32. In the case where the reactor 1 includes the core pieces 31 and 32 that have different relative permeabilities in this way, it is possible to reduce loss attributed to flux leakage, and a low-loss reactor can be obtained.

The relative permeability referred to here is obtained as follows. A ring-shaped measurement sample (having an outer diameter of 34 mm, an inner diameter of 20 mm, and a thickness of 5 mm) having a composition similar to that of the core pieces 31 and 32 is produced, a winding wire is wound around the measurement sample 300 times on the primary side and 20 times on the secondary side, and the B-H initial magnetization curve is then measured in the range of H=0 (Oe) to 100 (Oe). The highest value of B/H is obtained from the B-H initial magnetization curve and used as the relative permeability. The magnetization curve referred to here is the so-called DC magnetization curve.

If the relative permeability of the outer core piece 32 is higher than the relative permeability of the inner core piece 31, and furthermore the difference between the two relative permeabilities is increasingly large, particularly in the case where the relative permeability of the outer core piece 32 is a factor of 2 times or more the relative permeability of the inner core piece 31, the flux leakage between the core pieces 31 and 32 can be reduced more reliably. If the difference is even higher, such as the case where the relative permeability of the outer core piece 32 is a factor of 2.5 times or more, 3 times or more, 5 times or more, or 10 times or more the relative permeability of the inner core piece 31, flux leakage can be reduced even more easily, and preferably, flux leakage can be substantially eliminated.

The relative permeability of the inner core piece 31 is in the range of 5 to 50 inclusive, for example. The relative permeability of the inner core piece 31 can be reduced to the range of 10 to 45 inclusive, or furthermore to the range of 10 to 40, 35, or 30 inclusive. Magnetic saturation is not likely to occur in the magnetic core 3 if it includes such an inner core piece 31 that has a low permeability, thus making it possible to obtain a gapless structure having no magnetic gap. The gapless-structure magnetic core 3 has substantially no flux leakage that is attributed to a magnetic gap. This therefore facilitates reducing the size of the tubular gap $g_{31}$, and makes it possible to obtain a smaller reactor 1. Even if the tubular gap $g_{31}$ is small, the introduction space $g_{321}$ can be formed as described above, thus allowing the mold raw material to be easily introduced into the tubular gap $g_{31}$, and allowing the resin molded portion 6 to be formed easily.

The relative permeability of the outer core piece 32 is in the range of 50 to 500 inclusive, for example. The relative permeability of the outer core piece 32 can raised to 80 or higher, or furthermore 100 or higher (a factor of 2 times the case where the relative permeability of the inner core piece 31 is 50), 150 or higher, or 180 or higher. Such an outer core piece 32 that has a high permeability is likely to have a large difference with the relative permeability of the inner core piece 31. In one example, the relative permeability of the outer core piece 32 can be set to a factor of 2 times or more the relative permeability of the inner core piece 31. For this reason, even if the small area portions 321 of the outer core piece 32 are set smaller (thinner), flux leakage between the core pieces 31 and 32 can be reduced. Also, if the small area portions 321 are made smaller, the introduction space $g_{321}$ can be made larger, thus making it even easier for the mold raw material to be introduced into the tubular gap $g_{31}$.

3.6 Materials

The inner core pieces 31 and the outer core pieces 32 that constitute the magnetic core 3 are compacts that include a soft magnetic material, for example. One example of the soft magnetic material is a soft magnetic metal such as iron or an iron alloy (e.g., an Fe—Si alloy or an Fe—Ni alloy). Specific examples of core pieces include a resin core piece constituted by a compact of a composite material that includes a magnetic powder and a resin, a compressed powder piece constituted by a powder compact obtained by compression molding a magnetic powder, a ferrite core piece constituted a sintered body of a soft magnetic material, and a steel plate core piece constituted by a laminated body of stacked soft magnetic metal plates such as magnetic steel plates. Examples of the magnetic powder include a powder made of a soft magnetic material, and a coated powder that further includes an insulating coating. For example, if the magnetic core 3 is a mixed-type core that includes multiple types of core pieces selected from the group of a resin core piece described above, a compressed powder core piece, a ferrite core piece, and a steel plate core piece, the core can easily include inner core pieces 31 and outer core pieces 32 that have different relative permeabilities. Alternatively, an aspect is possible in which the magnetic core 3 includes only resin core pieces. In the case of resin core pieces, the relative permeability can be easily changed by changing the composition and content amount of the magnetic powder. It is sufficient to adjust the composition and content amount of the magnetic powder such that the inner core pieces 31 and the outer core pieces 32 each have a predetermined relative permeability.

The content amount of the magnetic powder in the composite material that constitutes the resin core piece is in the range of 30 vol % to 80 vol % inclusive, for example. The content amount of the resin in the composite material is in the range of 10 vol % to 70 vol % inclusive, for example. From the viewpoint of improving the saturation magnetic flux density and the heat dissipation performance, the content amount of the magnetic powder can be set to 50 vol % or higher, or furthermore 55 vol % or higher or 60 vol % or higher. From the view of improving fluidity in the manufacturing process, the content amount of the magnetic powder can be set to 75 vol % or lower, or furthermore 70 vol % or lower, and the content amount of the resin can be set higher than 30 vol %.

Examples of the resin in the composite material include a thermosetting resin, a thermoplastic resin, a cold setting resin, and a low temperature setting resin, for example. Examples of the thermosetting resin include an unsaturated polyester resin, an epoxy resin, a urethane resin, and a silicone resin. Examples of the thermoplastic resin include a polyphenylene sulfide (PPS) resin, a polytetrafluoroethylene (PTFE) resin, a liquid crystal polymer (LCP), a polyamide (PA) resin such as nylon 6 or nylon 66, a polybutylene terephthalate (PBT) resin, and an acrylonitrile butadiene styrene (ABS) resin. Other examples include a BMC (Bulk molding compound) in which calcium carbonate or glass fiber is mixed with unsaturated polyester, millable silicone rubber, and millable urethane rubber.

If the above-described composite material contains a non-magnetic and non-metal powder (filler) such as alumina or silica in addition to the magnetic powder and the resin, it is possible to further improve the heat dissipation performance. The content amount of the non-magnetic and non-metal powder is in the range of 0.2 mass % to 20 mass % inclusive, or furthermore 0.3 mass % to 15 mass % inclusive, or 0.5 mass % to 10 mass % inclusive.

The compact of the composite material can be manufactured by an appropriate molding method such as injection molding or cast molding. If the filling rate of the magnetic powder is be adjusted to a low rate in the manufacturing process, the relative permeability of the resin core piece can be reduced easily. For example, the relative permeability of the resin core piece is in the range of 5 to 50 inclusive.

The above-described powder compact is typically obtained by a process in which a mixed powder containing a magnetic powder and a binder is compression molded into a predetermined shape and then subjected to heat treatment after molding, for example. A resin or the like can be used as the binder. The content amount of the binder is approximately 30 vol % or less, for example. When heat treatment is performed, the binder dissipates or becomes a heat-denatured material. A powder compact is likely to contain a higher content amount of the magnetic powder (e.g., over 80 vol %, or 85 vol % or higher) than a compact of a composite material, and makes it easier to obtain a core piece that has a higher saturation magnetic flux density and relative permeability. For example, the relative permeability of the compressed powder core piece is in the range of 50 to 500 inclusive.

The inner core pieces 31 in this example are resin core pieces. The outer core pieces 32 in this example are compressed powder core pieces. Also, the inner core pieces 31 in this example have a relative permeability in the range of 5 to 50 inclusive. The outer core pieces 32 in this example have a relative permeability in the range of 50 to 500 inclusive. Also, the relative permeability of the outer core pieces 32 in this example is a factor of 2 times or more the relative permeability of the inner core pieces 31.

In the case where the inner core piece 31 is a resin core piece, the area $S_{321}$ of the connecting face 321*e* of the small area portion 321 of the outer core piece 32 is greater than or equal to a value obtained by multiplying the area $S_{31}$ of the end face 31*e* of the inner core piece 31 by a filling rate $\alpha$ of the magnetic powder in the inner core piece 31 ($S_{31}\times\alpha$), for example. Here, if the inner core piece 31 is a resin core piece, the magnetic powder located at the end face 31*e* of the inner core piece 31 substantially functions as a magnetic path. In other words, the area $S_{31}$ of the end face 31*e* can be considered to be the apparent magnetic path area, and the product value ($S_{31}\times\alpha$) can be considered to be the effective magnetic path area. If the area $S_{321}$ of the connecting face 321*e* of the small area portion 321 is greater than or equal to the product value ($S_{31}\times\alpha$), the connecting face 321*e* has a magnetic path area that is greater than or equal to the effective magnetic path area of the inner core piece 31. For this reason, it is possible to obtain the reactor 1 that can more reliably reduce flux leakage between the core pieces 31 and 32, while also having predetermined characteristics. The area $S_{321}$ in this example is greater than or equal to the product value ($S_{31}\times\alpha$).

The filling rate $\alpha$ (%) of the magnetic powder in the resin core piece can be, in simple terms, the total area percentage of the magnetic powder in a cross-section of the resin core piece, for example. The total area percentage is obtained as follows, for example. A cross-section of the resin core piece is observed with a microscope, the magnetic powder is extracted from an area S of the cross-section or an area S of a predetermined-sized field of view, and then a total area Sp of the magnetic powder is then obtained. The total area percentage is then obtained by $(Sp/S)\times100(\%)$. In strict terms, the magnetic powder is extracted by eliminating the resin and the like in the resin core piece, and then a volume V of the resin core piece and a volume Vp of the extracted magnetic powder can be used to obtain the filling rate $\alpha=(Vp/V)\times100(\%)$, for example.

4. Intermediate Member

The reactor 1 in this example further includes the intermediate members 5 that are disposed between the coil 2 and the magnetic core 3. The intermediate members 5 are typically made of an insulating material, and function as insulating members for insulation between the coil 2 and the magnetic core 3. The intermediate members 5 also function as positioning members for positioning the inner core pieces 31 and the outer core pieces 32 with respect to the winding portions 2*a* and 2*b*, for example. The intermediate members 5 in this example are rectangular frame-shaped members disposed at the joints between the inner core pieces 31 and the outer core pieces 32 and the vicinity thereof. These intermediate members 5 also function as members that form a flow path for the mold raw material during formation of the resin molded portion 6.

The intermediate members 5 each include through-holes, support portions, a coil groove portion, and a core groove portion, which are described below (see the outward intermediate portion 52 in JP 2017-135334A for an example of a similar shape). The through-holes penetrate from the side of the intermediate member 5 on which the outer core piece 32 is disposed (hereinafter called the outer core side) to the side on which the winding portions 2*a* and 2*b* are disposed (hereinafter called the coil side), and are for insertion of the two inner core pieces 31. In this example, the small area portions 321 of the outer core piece 32 are also inserted through the through-holes, and the end faces 31*e* of the inner core pieces 31 are connected to the connecting faces 321*e* of the small area portions 321 in the through-holes. The support portions protrude from portions of the inner peripheral faces that form the through-holes, and support portions of the inner core pieces 31 (in this example, the four corner portions). The coil groove portion is provided on the coil side of the intermediate member 5, and the end faces of the winding portions 2*a* and 2*b* and the vicinity thereof are fitted into the coil groove portion. The core groove portion is provided on the outer core side of the intermediate member 5, and the inward end faces 32*e* of the outer core pieces 32 and the vicinity thereof are fitted into the core groove portion.

The shape and size of the intermediate member 5 are adjusted such that flow paths for the mold raw material are provided in a state where the winding portions 2*a* and 2*b* are fitted into the coil groove portion, the two inner core pieces 31 are inserted into the through-holes, and the end faces 31*e* respectively abut against the connecting faces 321*e* of the small area portions 321 of the outer core pieces 32 that have been fitted into the core groove portion. The flow paths for the mold raw material are provided by providing gaps between the inner peripheral faces of the through-holes and the small area portions 321 of the outer core piece 32 or the locations where the inner core pieces 31 are not supported by the support portions, and between the large area portion 322 of the outer core piece 32 and the core groove portion, for example. Also, the flow paths for the mold raw material are provided such that the mold raw material does not leak out to the outer peripheral faces of the winding portions 2*a* and 2*b*. The shape, size, and the like of the intermediate member 5 can be selected as desired as long as it has the above-described functions, and known configurations can be used as a reference.

In this example, portions of the inner core pieces 31 are supported by the support portions, and the winding portions 2*a* and 2*b* are supported by the inner face of the coil groove portion, and therefore the through-holes and the coil groove portion are provided so as to form the tubular gap $g_{31}$ between the winding portion 2*a* (or 2*b*) and the inner core pieces 31. Also, a portion of the inward end face 32*e* of the outer core piece 32 is supported by the groove bottom face of the core groove portion, and therefore the through-holes and the core groove portion are provided such that the introduction spaces $g_{321}$ are formed between the outer peripheral faces of the small area portions 321 that protrude from the inward end face 32*e* and portions of the inner peripheral faces of the through-holes, and a gap is formed between the outer peripheral face of the large area portion 322 and the inner peripheral face of the core groove portion. When the intermediate members 5 that include the through-holes, the coil groove portion, and the core groove portion are combined with the coil 2 and the magnetic core 3, a communication space extends from the gap around the outer core piece 32 to the tubular gap $g_{31}$ via the introduction spaces $g_{312}$. This communication space is used as a flow path for the mold raw material.

The constituent material of the intermediate member 5 can be an insulating material such as any of various types of resin, for example. Examples include the various types of thermoplastic resins and thermosetting resins described in the section regarding the composite materials that constitute the resin core pieces. The intermediate member 5 can be manufactured using a known molding method such as injection molding.

5. Resin Molded Portion 5.1 Overview

Due to covering outer peripheral faces of at least one core piece provided in the magnetic core 3, the resin molded portion 6 has a function of protecting the core piece from the outside environment, a function of mechanically protecting the core piece, and a function of improving the insulation performance between the core piece and the coil 2 and peripheral components. Moreover, due to exposing the winding portions 2*a* and 2*b* instead of covering the outer peripheral faces thereof, the resin molded portion 6 allows the winding portions 2*a* and 2*b* to directly come into contact with a cooling medium such as a liquid coolant, thus improving the heat dissipation performance.

In addition to the two inner resin portions 61 that cover the outer peripheral faces of the portions of the two inner core pieces 31 that are housed inside the winding portions 2*a* and 2*b*, the resin molded portion 6 further includes the thick portions 63 that cover the connection locations between the inner core pieces 31 and the outer core pieces 32. The resin molded portion 6 in this example further includes the outer resin portions 62 that cover the outer peripheral faces of the outer core pieces 32. The resin molded portion 6 in this example is an integrated body in which the inner resin portions 61, the thick portions 63, and the outer resin portions 62 are continuous with each other. Also, the resin molded portion 6 in this example holds the assembly of the magnetic core 3 and the intermediate members 5 in the integrated state.

The following describes the inner resin portions 61, the outer resin portions 62, and the thick portions 63 in this order.

5.2 Inner Resin Portion

The inner resin portions 61 in this example are each a tubular body obtained by filling the tubular gap $g_{31}$ (here, a quadrangular tube-shaped space), which is between the inner peripheral faces of the winding portion 2*a* (or the 2*b*) and the outer peripheral faces of the inner core pieces 31 with the constituent resin of the resin molded portion 6. In this example, the inner resin portion 61 has a substantially uniform thickness $t_{61}$ (FIG. 1) over the entire length thereof, with the exception of the portions that cover the introduction grooves 315 of the inner core pieces 31. In the case where the magnetic core 3 has a gapless-structure as in this example, the size of the tubular gap $g_{31}$ can be reduced, and the thickness $t_{61}$ of the inner resin portion 61 can be reduced in accordance with the size of the tubular gap $g_{31}$ (FIG. 2B). The thickness $t_{61}$ of the inner resin portion 61 can be selected as appropriate. For example, the thickness $t_{61}$ of the inner resin portion 61 is in the range of 0.1 mm to 4 mm inclusive, or further in the range of 0.3 mm to 3 mm, 2.5 mm, 2 mm, or 1.5 mm inclusive. The thickness of the portions of the inner resin portion 61 that cover the introduction grooves 315 is the sum of the above-described thickness $t_{61}$ and the depth of the introduction grooves 315.

5.3 Outer Resin Portion

The outer resin portion 62 in this example covers substantially the entirety of the outer peripheral faces of the outer core piece 32, with the exception of the small area portions 321 that are connected to the two inner core pieces 31 and the vicinity thereof, and the outer resin portion 62 has a substantially uniform thickness. The region of the outer resin portion 62 that covers the outer core piece 32, as well as the thickness and the like thereof can be selected as appropriate. For example, the thickness of the outer resin portion 62 can be set the same as the thickness $t_{61}$ of the inner resin portion 61, or set to a different thickness.

5.4 Thick Portion

The thick portions 63 in this example are located between the inner resin portions 61 and the outer resin portions 62, and cover the connection locations between the core pieces 31 and 32, including the abutting portions between the end faces 31*e* of the inner core pieces 31 and the connecting faces 321*e* of the small area portions 321 of the outer core pieces 32. The thick portions 63 are obtained by the step portions between the small area portions 321 of the outer core pieces 32 and the end faces 31*e* of the inner core pieces 31 being filled with the constituent resin of the resin molded portion 6. For this reason, a thickness $t_{63}$ of the thick portions 63 is greater than the thickness of the portions that cover the inner core pieces 31 (here, the thickness $t_{61}$ of the inner resin portions 61) by an amount corresponding to the above-described step height (FIG. 1). The higher the thickness $t_{63}$ of the thick portions 63 is, the higher the connection strength between the core pieces 31 and 32 is likely to be, and the higher the integrated body strength is likely to be for the magnetic core 3 that is held in the integrated state by the resin molded portion 6. Given that the thickness $t_{63}$ of the thick portions 63 corresponds to the sum of the thickness $t_{61}$ of the inner resin portions 61 and the above-described step height, the thickness $t_{63}$ can be increased by increasing at least either the thickness $t_{61}$ or the step height, thus further improving the connection strength. The higher the thickness $t_{61}$ of the inner resin portions 61 is, the easier it is to obtain effects such as protecting the core pieces from the outside environment, mechanically protecting the core pieces, and ensuring insulation performance, but this increases the weight and size of the resin molded portion 6, thus leading to an increase in the weight and size of the reactor 1. The higher the above-described step height is, the more likely it is to invite a decrease in the above-described magnetic characteristics, for example. Accordingly, the thicknesses $t_{61}$ and $t_{63}$ are selected in consideration of weight, size, magnetic characteristics, strength, and the like.

5.5 Constituent Materials

Examples of the constituent material of the resin molded portion 6 include various types of resin, including a thermoplastic resin such as a PPS resin, a PTFE resin, LCP, a PA resin, or a PBT resin. If the constituent material is a compound resin that contains any of such resins and any of the previously described fillers that have excellent thermal conductance, it is possible to obtain the resin molded portion 6 that has excellent heat dissipation performance. If the constituent resin of the resin molded portion 6 and the constituent resin of the intermediate members 5 are the same resin, the bondability between them is excellent, and the thermal expansion coefficient is the same for both, thus making it possible to suppress peeling, cracking, and the like caused by thermal stress. The resin molded portion 6 can be formed using injection molding or the like.

5.6 Reactor Manufacturing Method

The reactor 1 of the first embodiment can be manufactured by, for example, combining the core pieces that constitute the coil 2 and the magnetic core 3 (here, the two inner core pieces 31 and the two outer core pieces 32) with the intermediate members 5, placing the assembly in a mold (not shown) for the resin molded portion 6, and then covering the assembly with the mold raw material.

In this example, the above-described assembly can be easily obtained by disposing the winding portions 2*a* and 2*b* on the coil sides of the intermediate members 5, inserting the two inner core pieces 31 and the small area portions 321 into the through-holes, and disposing the two outer core pieces 32 on the outer core sides of the intermediate members 5. In the assembly obtained before the formation of the resin molded portion 6, communication spaces extend from the outer core piece 32 sides to the winding portions 2*a* and 2*b* as described above, and such spaces can be favorably used as flow paths for the mold raw material.

The above-described assembly is placed in the mold, and the mold is filled with the mold raw material. This filling can be performed in one direction from one outer core piece 32 to the other outer core piece 32, or in two directions from the outer core pieces 32 toward the inside of the winding portions 2*a* and 2*b*. In both filling methods, the filling of the mold raw material starts at a position corresponding to the outer end face 32*o* of one of the outer core pieces 32, and the mold raw material flows over the outer core pieces 32 into the end portions of the winding portions 2*a* and 2*b*. The mold raw material flows over the outer peripheral faces of the outer core pieces 32 and into the introduction spaces $g_{321}$, and then flows through the introduction spaces $g_{321}$ into the tubular gaps $g_{31}$. In both of the filling methods, the manufacturability of the reactor 1 is excellent due to both of the outer core pieces 32 being provided with the two small area portions 321 as in this example. This is because the magnetic core 3 can be easily assembled, degassing and the like can be easily performed due to the introduction spaces $g_{312}$, and the mold raw material can be introduced more easily. In the case of performing one-way filling, an aspect is possible in which only one of the outer core pieces 32 has the two small area portions 321, and the outer end face 32*o* of that outer core piece 32 is disposed at the filling start position. In the case of performing one-way filling, the outer core pieces 32 can each be provided with the two small area portions 321.

5.7 Applications

The reactor 1 of the first embodiment can be used as a part in a circuit for performing voltage step-up or step-down operations, such as a constituent component of any of various types of converters and power conversion apparatuses. Examples of such converters include in-vehicle converters (typically DC-DC converters) for installation in vehicles such as hybrid automobiles, plug-in hybrid automobiles, electric automobiles, and fuel cell automobiles, and converters in air conditioners.

5.8 Effects

The reactor 1 of the first embodiment includes the thick portions 63 at positions for covering the connection locations between the inner core pieces 31 and the outer core pieces 32 in the resin molded portion 6. The thickness of the thick portions 63 is greater than the thickness $t_{61}$ of the inner resin portions 61 that cover the inner core pieces 31 in the resin molded portion 6, and are less likely to crack. With the reactor 1 of the first embodiment that includes such thick portions 63, it is possible to improve the integrated body strength of the magnetic core 3 that is held in an integrated state by the resin molded portion 6, and the strength is excellent. Even if the core pieces 31 and 32 are not connected to each other with use of an adhesive, the magnetic core 3 can be firmly held in the integrated state due to the provision of the thick portions 63. The resin molded portion 6 in this example includes the inner resin portions 61 and the outer resin portions 62, which are continuous and integrated with each other, and in view of this as well, the rigidity of the magnetic core 3 as an integrated body is improved by the resin molded portion 6. Also, in the reactor 1, the thick portions 63 are provided at predetermined locations in the resin molded portion 6, thus achieving a smaller size than in the case where the thickness of the entirety of the resin molded portion 6 is increased, while also achieving excellent strength.

Furthermore, in the reactor 1 of the first embodiment, the outer core piece 32 includes the large area portion 322 having the magnetic path sectional area $S_{32}$ that is greater than the magnetic path sectional area $S_{31}$ of the inner core pieces 31, and also includes the small area portions 321 having the magnetic path sectional area $S_{321}$ that is less than the magnetic path sectional area $S_{31}$, at the connections with the inner core pieces 31. The provision of the small area portions 321 makes it possible to form the introduction spaces $g_{321}$ in the vicinity of the opening of the tubular gap $g_{31}$, and therefore in the reactor 1 of the first embodiment, the mold raw material can be easily introduced into the tubular gap $g_{31}$ through the introduction spaces $g_{321}$, and the resin molded portion 6 can be formed easily.

Furthermore, in the reactor 1 of the first embodiment, the relative permeability of the outer core piece 32 is higher than the relative permeability of the inner core piece 31. For this reason, even if the small area portions 321, which form the connections between the inner core pieces 31 and the outer core piece 32, is smaller than the inner core pieces 31, it is possible to reduce flux leakage between the core pieces 31 and 32. Accordingly, with the reactor 1 of the first embodiment, it is possible to reduce an increase in loss attributed to flux leakage, a low-loss reactor can be obtained.

Also, in the reactor 1 of the first embodiment, the insulation performance between the winding portions 2*a* and 2*b* and the two inner core pieces 31 is raised by the two inner resin portions 61. Furthermore, in the reactor 1, the winding portions 2*a* and 2*b* are exposed by the resin molded portion 6 and not covered by it, thus allowing direct contact with a cooling medium such as a liquid coolant, and achieving excellent heat dissipation performance. In particular, in the reactor 1, the outer core piece 32 includes the large area portion 322, and therefore heat is more easily dissipated from the large area portion 322 than in the case where the outer core piece has the uniform magnetic path sectional area $S_{321}$, and the large area portion 322 easily comes into contact with the aforementioned cooling medium, and in light of this as well, the heat dissipation performance is excellent. Due to the provision of the large area portion 322, the heat dissipation performance is even better than in the case of having a larger surface area than that of an outer core piece that has a uniform magnetic path sectional area $S_{31}$.

The reactor 1 in this example furthermore has the following effects.

(1) The connection strength between the core pieces 31 and 32 is further improved, and moreover the mold raw material is more easily introduced into the tubular gap $g_{31}$.

This is because the thick portions 63 and the introduction spaces $g_{321}$ are provided as ring-shaped portions that extend around the small area portions 321 of the outer core piece 32.

This also because the inner core piece 31 is provided with multiple introduction grooves 315. The resin molded portion 6 in this example includes multiple thick resin portions that are continuous with the thick portions 63 and cover the introduction grooves 315.

The inner peripheral faces that form the introduction grooves 315 include an inclined face that guides the mold raw material toward the tubular gap $g_{31}$, thus making the aforementioned effect possible.

(2) It is possible to obtain a reactor 1 that has even lower loss.

The inner core piece 31 is a composite material compact having a relative permeability in the range of 5 to 50 inclusive, and the outer core piece 32 is a powder compact having a relative permeability in the range of 50 to 500 inclusive, that is to say a relative permeability that is a factor of 2 times or more the relative permeability of the inner core piece 31. For this reason, it is possible to obtain the gapless-structure magnetic core 3, thus substantially eliminating loss attributed to a magnetic gap, thereby making the aforementioned effect possible.

The small area portions 321 of the outer core piece 32 are exposed from the winding portion 2*a* (or 2*b*), and it is possible to reduce loss attributed to flux leakage from the small area portion 321, thus making the aforementioned effect possible.

(3) It is possible to obtain a more compact reactor 1.

This is because due to having a gapless structure, the size of the tubular gap $g_{31}$ can be reduced, and the thickness $t_{61}$ of the inner resin portions 61 can be reduced.

The inner core piece 31 is a composite material compact, and the outer core piece 32 is a powder compact, and therefore the magnetic core 3 can more easily be smaller than in the case of a magnetic core that is constituted by composite material compacts, thus making the aforementioned effect possible.

Note that even if the tubular gap $g_{31}$ is small, the introduction spaces $g_{321}$ can be formed around the small area portions 321 as described above, thus making it easier to introduce the mold raw material into the tubular gap $g_{31}$, and making it easier to form the resin molded portion 6.

(4) Corrosion resistance is also excellent due to the inner core pieces 31 being composite material compacts and thus containing a resin. Also, even in the case of having uneven portions due to the provision of the introduction grooves 315, the inner core piece can be molded easily and precisely, and the inner core piece 31 has excellent manufacturability.

(5) Corrosion resistance is excellent due to the outer core pieces 32 being powder compacts, and due to the outer core pieces 32 being substantially completely covered by the outer resin portions 62.

(6) Fewer core pieces make up the magnetic core 3, and fewer components need to be combined (in this example, a total of seven components include the coil 2, the core pieces, and the intermediate members 5), and therefore the ease of assembly is also excellent.

(7) Fewer core pieces make up the magnetic core 3, and there are fewer joints between the core pieces, and in view of this as well, the strength is excellent.

The present disclosure is not limited to the foregoing examples, and all changes which come within the meaning and range of equivalency are intended to be embraced therein.

For example, any one or more of the following changes (a) to (d) can be made to the first embodiment described above.

(a) The reactor includes a self-fusing coil.

In this case, a winding wire that includes a fusing layer is used, and after the winding portions 2*a* and 2*b* are formed, the fusing layer is melted by the application of heat and then allowed to harden, and thus adjacent turns are bonded together by the fusing layer. This enables the winding portions 2*a* and 2*b* to maintain their shape when combining the coil 2 and the magnetic core 3, thus achieving excellent workability.

(b) The reactor includes multiple inner core pieces and a gap portion that is disposed between adjacent inner core pieces.

(c) The positions of the connecting faces 321*e* of the small area portions 321 with respect to the end faces 31*e* of the inner core piece 31, and the external shape and size of the small area portions 321 are changed such that the thick portions 63 are C-shaped instead of ring-shaped, or multiple thick portions 63 are arranged with gaps therebetween in the peripheral direction of the inner core pieces 31.

In these cases as well, the thick portions 63 are provided at the connection locations between the core pieces 31 and 32. For this reason, the connection strength between the core pieces 31 and 32 is more excellent than in the case where the thick portions 63 are not provided, and the magnetic path sectional area $S_{321}$ of the small area portions 321 can be ensured to be higher. In the case of providing multiple thick portions 63, the small area portions 321 are gear-shaped columnar bodies, for example.

(d) The reactor includes at least one of the following.

(d1) A sensor (not shown) that measures a physical quantity of the reactor, such as a temperature sensor, a current sensor, a voltage sensor, or a magnetic flux sensor.

(d2) a heat sink (e.g., a metal plate) that is attached to at least one portion of an outer peripheral face of the coil 2.

(d3) A joining layer (an adhesive layer or the like, and preferably a layer that has excellent insulation performance) that is disposed between the installation face of the reactor and the installation target or the heat sink (d2).

(d4) An attachment portion that is integrated with the outer resin portion 62 and is for fixing the reactor to the installation target.

The invention claimed is:

1. A reactor comprising:

a coil having a winding portion;

a magnetic core that is disposed extending inside and outside the winding portion, and is configured to form a closed magnetic circuit; and a resin mold that includes an inner resin disposed between the winding portion and the magnetic core, and does not cover an outer peripheral face of the winding portion, wherein the magnetic core includes an inner core piece that has a predetermined magnetic path sectional area and is disposed inside the winding portion, and an outer core piece that has a small area portion having a connecting face that is connected to an end face of the inner core piece and has a smaller area than the end face, and a large area portion having a magnetic path sectional area that is larger than the area of the end face of the inner core piece, the large area portion being exposed from the winding portion, a relative permeability of the outer core piece is higher than a relative permeability of the inner core piece, and the resin mold has a thick portion that covers a connection location between the end face of the inner core piece and the connecting face of the small area portion, the thick portion being thicker than a portion of the resin mold that covers an outer peripheral face of the inner core piece.

2. The reactor according to claim 1, wherein:

the inner core piece is formed by a compact made of a composite material that contains a magnetic powder and a resin, and the area of the connecting face is greater than or equal to a value obtained by multiplying the area of the end face of the inner core piece by a filling rate of the magnetic powder.

3. The reactor according to claim 1, wherein the inner core piece includes an introduction groove that is open at an outer peripheral face and the end face of the inner core piece.

4. The reactor according to claim 1, wherein:

a relative permeability of the inner core piece is in a range of 5 to 50 inclusive, and a relative permeability of the outer core piece is a factor of 2 times or more the relative permeability of the inner core piece.

5. The reactor according to claim 4, wherein the relative permeability of the outer core piece is in a range of 50 to 500 inclusive.

6. The reactor according to claim 1, wherein the small area portion is exposed from the winding portion.

* * * * *